US006354227B1

(12) United States Patent
Feldpausch et al.

(10) Patent No.: US 6,354,227 B1
(45) Date of Patent: Mar. 12, 2002

(54) ADJUSTABLE TABLE WITH WORKSURFACE HAVING WRITE-ON SURFACE ADAPTED FOR USE AS PROJECTION SCREEN

(75) Inventors: Thomas G. Feldpausch, Hastings; James P. Keane, Grand Rapids; George V. Weller, Shelbyville; Mitchell Niewiadowski, Lowell; Joseph R. Branc, Grand Rapids, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/481,191

(22) Filed: Jan. 11, 2000

(51) Int. Cl.[7] ..... A47B 37/00
(52) U.S. Cl. ..... 108/50.11; 108/147; 108/10
(58) Field of Search ..... 108/144.11, 147.19, 108/148, 147, 50.11, 23, 10, 7, 145; 248/188.2, 188.5, 412, 414, 157

(56) References Cited

U.S. PATENT DOCUMENTS

| | | | |
|---|---|---|---|
| 173,269 | A | 2/1876 | Chinnock |
| 275,598 | A | 4/1883 | Crandall |
| 346,795 | A | 8/1886 | Wilcox |
| 362,589 | A | 5/1887 | Shinn |
| 948,905 | A | 2/1910 | Snyder |
| 1,031,637 | A | 7/1912 | Fischer |
| 1,200,071 | A | 10/1916 | Barler |
| 1,735,162 | A | 11/1929 | Favour |
| 1,872,849 | A | 8/1932 | Townes |
| 1,912,096 | A | 2/1933 | Reuter |
| 1,898,514 | A | 5/1933 | Wilhelm |
| 1,981,052 | A | 11/1934 | Lehner |
| 2,010,290 | A | 8/1935 | Campbell |
| 2,010,306 | A | 8/1935 | Leech |
| 2,191,099 | A | 2/1940 | Shenton |
| 2,364,191 | A | 12/1944 | Campbell |

(List continued on next page.)

FOREIGN PATENT DOCUMENTS

| | | |
|---|---|---|
| WO | WO9639903 | 12/1996 |

OTHER PUBLICATIONS

Association for Computing Machinery, Proceedings of the Conference on Computer Supported Cooperative Work, Oct. 22–26, 1994 (12 pages).
Association for Computing Machinery, Proceedings of the Conference on Computer Supported Cooperative Work, Oct. 31–Nov. 4, 1992 (11 pages).
GE Plastics, VALOX FR–1 Film Product Data, Date unknown, but prior to Mar. 13, 1997 (2 pages).
Microfield Graphics, Inc., "SoftBoard Sales Guide," Jun., 1995 (55 pages).
MicroTouch Business Products Division, WhiteBoard, Data unknown, but prior to Mar. 13, 1997 (1 page).
TEKRA, Marnot Hardcoated Films Technical Data Sheets, Date unknown, but prior to Mar. 13, 1997 (12 pages).
WallTalkers, Inc. "Presentation Wallcoverings and Systems," Date unknown, but prior to Mar. 13, 1997 (4 pages).

* cited by examiner

*Primary Examiner*—Jose V. Chen
(74) *Attorney, Agent, or Firm*—Price, Heneveld, Cooper, DeWitt & Litton

(57) ABSTRACT

A portable table including a vertically adjustable upright support, a worksurface connected to the upright support and a one-way locking apparatus engagable with the upright support for locking the upright support in a vertically adjustable position. While the one-way locking apparatus is engaged, the upright support is only upwardly vertically adjustable. The one-way locking apparatus disengages from the upright support when the upright support is fully extended and reengages with the upright support when the upright support is lowered to a lowest vertical position.

31 Claims, 7 Drawing Sheets

U.S. PATENT DOCUMENTS 2,388,056 A 10/1945 Hendricks
2,397,405 A 3/1946 Burkeman
2,499,859 A 7/1950 Halter
2,528,311 A 10/1950 Hurley
2,710,048 A 6/1955 Dawson
2,741,868 A 4/1956 Saunders
2,742,082 A 4/1956 Lief
D183,556 S 10/1958 Close
D183,557 S 10/1958 Close
3,080,835 A 3/1963 Guglielmi
D197,653 S 3/1964 Sundberg et al.
3,273,517 A 9/1966 Amthor, Jr. et al.
3,351,409 A 11/1967 McGuire
3,467,352 A 9/1969 Bohler
3,481,286 A * 12/1969 Mar et al.
3,640,228 A 2/1972 Busse
3,688,419 A 9/1972 Woolman
3,715,995 A * 2/1973 Thomas
3,737,136 A * 6/1973 Snurr
3,778,911 A 12/1973 Woolman
3,785,299 A 1/1974 Caperton, Jr.
3,818,609 A 6/1974 Woolman
3,846,011 A 11/1974 Stein
3,869,992 A 3/1975 Kramer
3,871,780 A 3/1975 Svensson
3,976,016 A * 8/1976 Longbottom
4,046,437 A 9/1977 Caron et al.
4,099,469 A 7/1978 Sahli
4,457,717 A 7/1984 Chika
4,526,334 A * 7/1985 Rantakari
4,601,246 A 7/1986 Damico ..... 108/144
4,879,954 A 11/1989 Sawamura et al.
4,897,954 A 2/1990 Gustavsson
5,033,843 A 7/1991 Kolff
5,131,333 A * 7/1992 Karasawa et al.
5,160,951 A 11/1992 Lander
5,197,393 A 3/1993 Yeakle
5,224,429 A 7/1993 Borgman et al.
5,243,921 A 9/1993 Kruse et al.
5,289,287 A 2/1994 Dargis et al.
5,307,205 A 4/1994 Ludwig, Jr. et al.
5,322,025 A 6/1994 Sherman et al.
5,361,164 A 11/1994 Steliga
5,523,790 A 6/1996 Kalua
5,553,550 A 9/1996 Doyle
5,598,788 A 2/1997 Jonker
5,601,037 A 2/1997 Meyer et al.
5,682,825 A 11/1997 Manner
5,845,590 A 12/1998 Seidl
5,857,415 A 1/1999 Richard
5,992,810 A 11/1999 Crinion et al.

ADJUSTABLE TABLE WITH WORKSURFACE HAVING WRITE-ON SURFACE ADAPTED FOR USE AS PROJECTION SCREEN

BACKGROUND OF THE INVENTION

The present invention relates to tables, and in particular to a table with an adjustable worksurface that can be used as a write-on surface and a projection screen.

Tables with worksurfaces are used for a wide variety of applications, such as for computer desks, drafting tables, etc. Often worksurfaces are made to be angularly and vertically adjustable in order to fit the particular height and need of a user. Separately, vertical surfaces can be used for chalkboards, markerboards and projection screens.

Heretofore, many worksurfaces on tables are made to be vertically and angularly adjustable by manually-operated levers, brakes or ratcheting latches. Often the levers must be operated by a user in order to lock the worksurface in position, such as to force a pin connected to the lever into a hole in one telescoping leg of the table. Alternatively, a brake or ratcheting latch is sometimes used to lock the worksurface in a vertically adjustable level. If a brake is used by screwing the brake into contact with one telescoping leg of a table through a hole in the other telescoping leg of a table, the worksurface has a tendency to lower as the brake becomes loose or unscrewed. If levers or ratcheting latches are used, the worksurface can only be raised or lowered to a predetermined level of the ratchet or hole in the leg. In all of the above mechanisms, the operator must manipulate the adjustment device to both lock and unlock the worksurface. This can be inconvenient to the operator, particularly where the adjustment mechanism is in a hidden position for aesthetics, or where the adjustment motion is not intuitive or obvious to the operator. These tables tend to be very heavy and bulky because of all of the working parts. Furthermore, the adjustable elements can be expensive. Finally, the tables with adjustable worksurfaces are occasionally limited to particular tasks.

Accordingly, an apparatus solving the aforementioned disadvantages and having the aforementioned advantages is desired.

SUMMARY OF THE INVENTION

One aspect of the present invention is to provide a portable table including a vertically adjustable upright support, a worksurface connected to the upright support and a one-way locking apparatus engagable with the upright support for locking the upright support in a vertically adjustable position. While the one-way locking apparatus is engaged, the upright support is only upwardly vertically adjustable. The one-way locking apparatus disengages from the upright support when the upright support is fully extended and reengages with the upright support when the upright support is lowered to a lowest vertical position.

Another aspect of the present invention is to provide a portable table having a vertically adjustable upright support and a translucent planar member pivotally connected to the upright support. An extendable locking device is pivotally connected to the upright support and to the angularly adjustable worksurface for locking the angularly adjustable worksurface in an angularly adjustable position.

Yet another aspect of the present invention is to provide a worksurface having a translucent panel with a first surface and a second surface opposite to the first surface. The first surface has a surface finish configured to be used as a projection screen and a first erasable marker board. The first surface is further configured to reflect a first projected image to be viewed on the projection screen and the translucent panel is additionally configured to transmit the first projected image through the translucent panel to be viewed from the second surface on the projection screen.

The objects of the present invention include providing a table that can be easily adjusted. Another object is to provide a table that is highly portable with many uses. The table provides a self-locking vertically adjustable worksurface. Therefore, the table has few parts that a user has to handle in order to vertically and angularly adjust the table. The table also provides a worksurface that can be raised and angularly adjusted at infinitely small increments. The table further provides a worksurface that doubles as a projection screen and a markerboard that can be written upon with dry erase markers. The table also provides a worksurface that can be angularly and vertically adjusted simultaneously, with the worksurface automatically locking into place when the worksurface is released. The worksurface provides a first surface and a second surface that can be positioned between two work spaces and can be used at different times by the same or different groups of people. The vertically and angularly adjusting table is efficient in use, economical to manufacture, capable of a long operable life, and particularly adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 2:
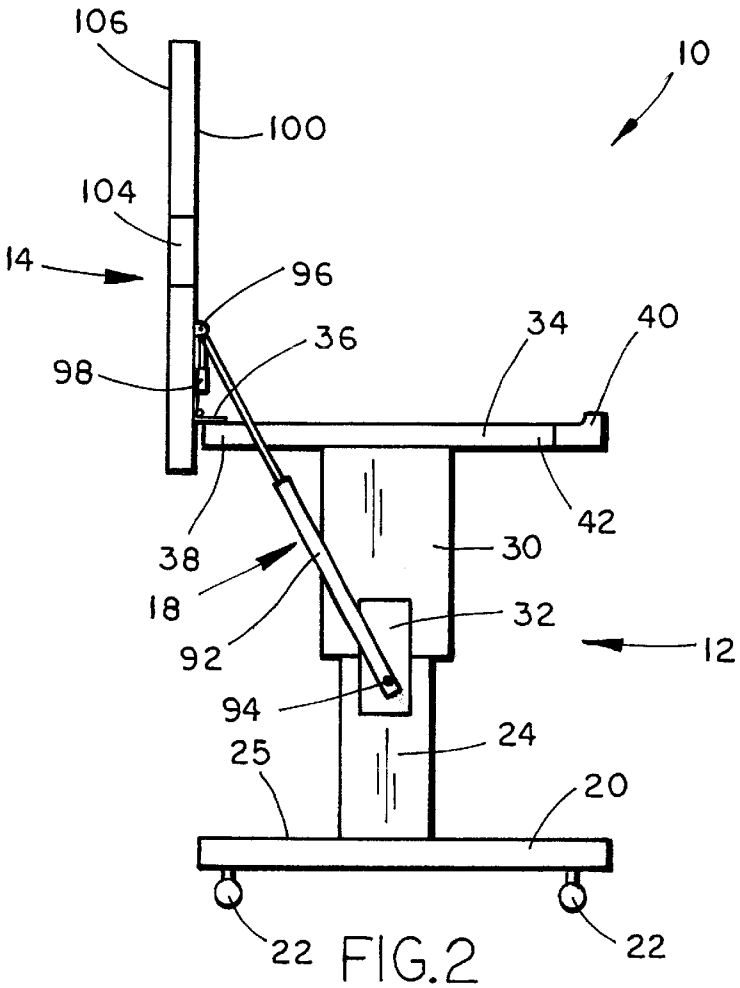
FIG. 2 is a side view of the vertically and angularly adjustable table of the present invention with the worksurface in a vertical position.
Figure 1:
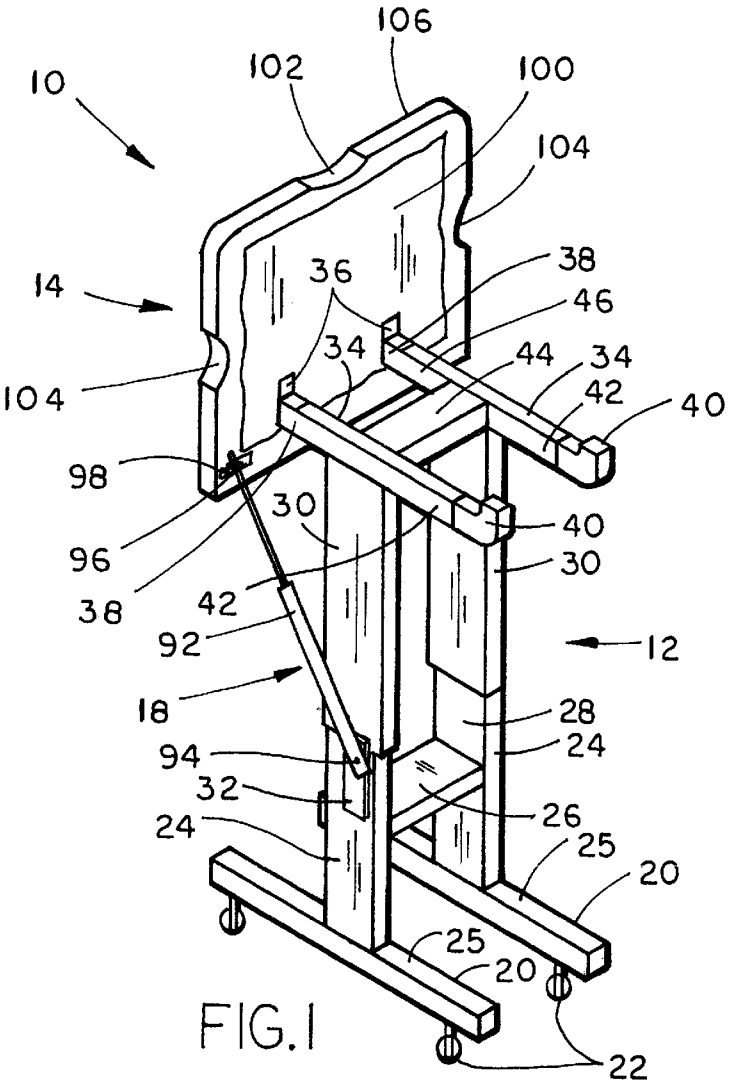
FIG. 1 is a perspective view of a vertically and angularly adjustable table embodying the present invention.
Figure 3:
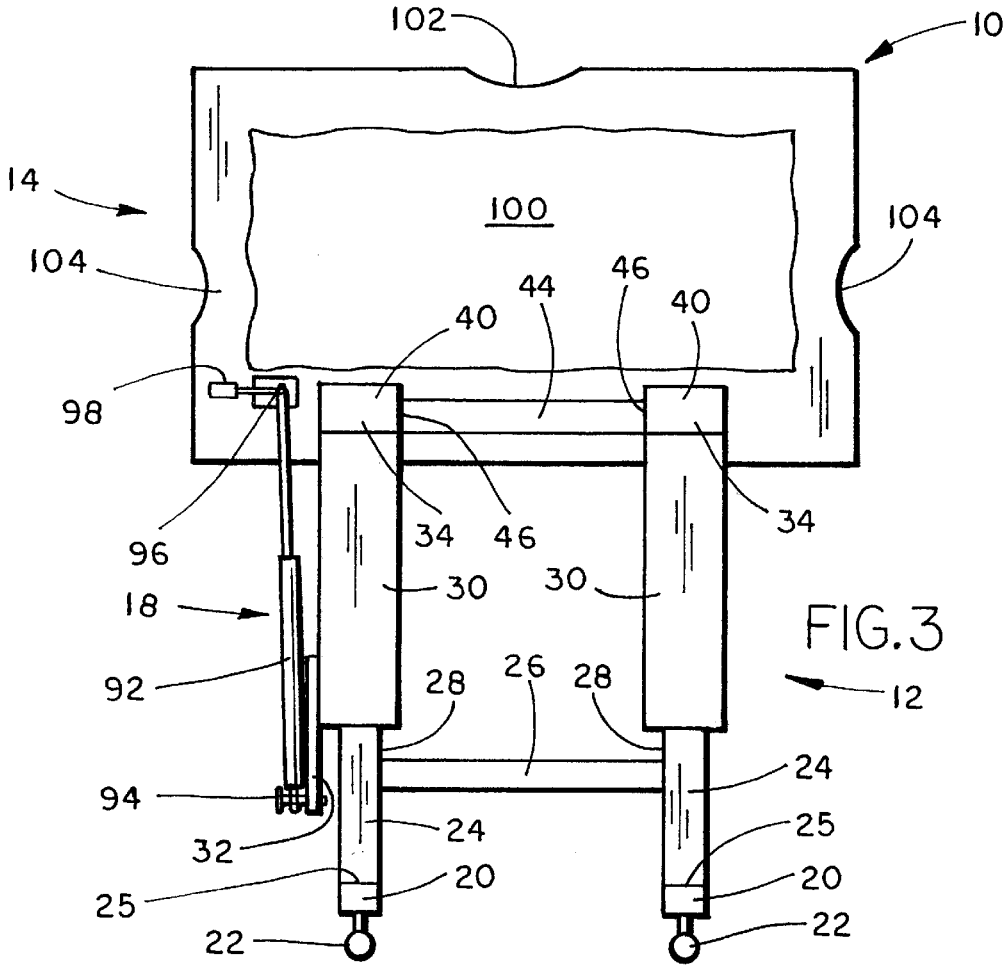
FIG. 3 is a front view of the vertically and angularly adjustable table of the present invention with the worksurface in the vertical position.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a portable table embodying the present invention. The portable table 10 including a vertically adjustable upright support 12, a worksurface 14 connected to the upright support 12, and a one-way locking apparatus 16 (FIGS. 5–10) engagable with the upright support 12 for locking the upright support 12 in a vertically adjustable position. While the one-way locking apparatus 16 is engaged, the upright support 12 is only upwardly vertically adjustable. The one-way locking apparatus 16 disengages from the upright support 12 when the upright support 12 is fully extended (FIG. 9) and reengages with the upright support 12 when the upright support 12 is lowered to a lowest vertical position (FIG. 10). As described in more detail below, an extendable locking device 18 can be pivotally connected the upright support 12 and to the worksurface 14 for locking the worksurface 14 in an angularly adjustable position.

Figure 4:
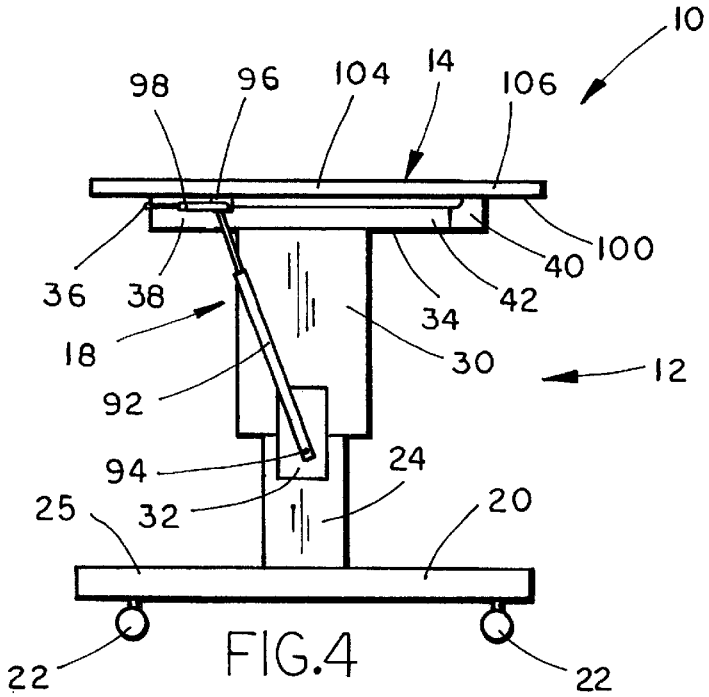
FIG. 4 is side view of the vertically and angularly adjustable table of the present invention with the worksurface in a horizontal position.
Figure 5:
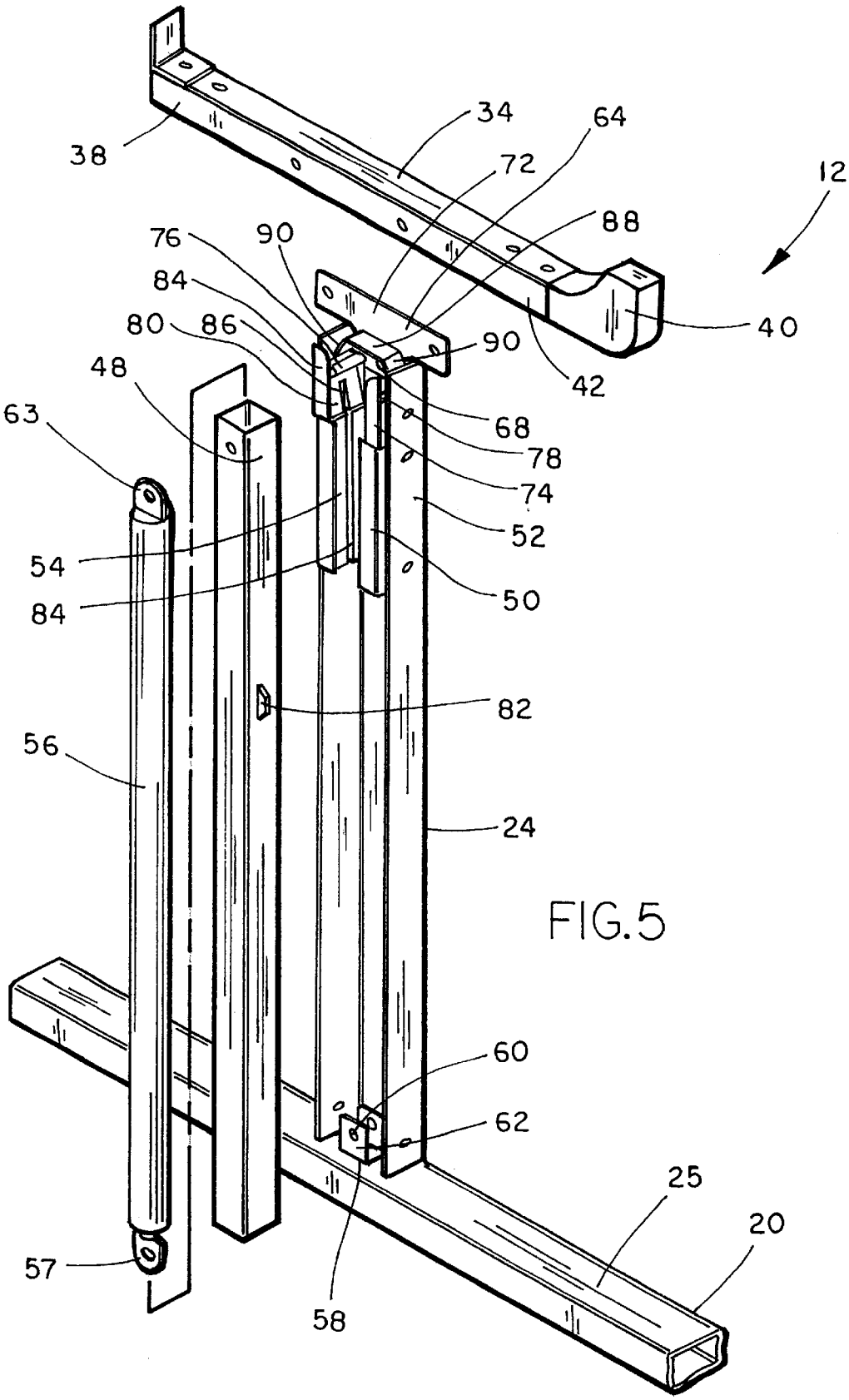
FIG. 5 is an exploded view of a portion of the upright support with a sheath and the side of an outer tube removed to reveal a locking apparatus of the present invention.

The illustrated upright support 12 (FIGS. 1–5) has two substantially parallel feet 20, preferably with floor-engaging castors 22 on the bottom of each of the two feet 20. The two substantially parallel feet 20 could also have rubber stops at the bottom in order to protect the feet 20 and the ground from scratches and to keep the table 10 stationary. Two outer tubes 24, one for each of the two feet 20, project upward from a top surface 25 of the two feet 20. Preferably between the two outer tubes 24 near the feet 20 is a lower brace 26. The lower brace 26 is substantially perpendicular to the feet 20 and is connected to an inside periphery 28 of each of the outer tubes 24 for keeping the upright support 12 erect. It is contemplated, however, that upright support 12 could be made without the lower brace 26. Around the outside of each of the outer tubes 24 are sheaths 30. The sheaths 30 telescope with the outer tubes 24 and protect the one-way locking apparatus 16, which will be described in more detail below. One of the sheaths 30 has a strap 32 connected to the extendable locking device 18, which also will be described in more detail below. The strap 32 is a panel that projects past and is attached to a lower end of one of the side walls of one of the sheaths 30. Connected to the tops of each the sheaths 30 is a worksurface support 34. The worksurface supports 34 are substantially parallel to each other and to the feet 20. The worksurface supports 34 each have a hinge 36 on the top of a first end 38 and a pad 40 at a second end 42. The hinges 36 are connected to the worksurface 14 and allow the worksurface 14 to rotate relative to the upright support 12. The pads 40 are substantially L-shaped, with one end of the pad 40 stuck into the second end 42 of the worksurface support 34 and one end of the pad 40 projecting upward. The pads 40 safely hold and support the worksurface 14 when the worksurface 14 is horizontal (FIG. 4). Between the two worksurface supports 34 is an upper brace 44. The upper brace 44 stabilizes the worksurface supports 34 and is connected to an inside periphery 46 of each of the worksurface supports 34 in the manner of the lower brace 26. The feet 20, the lower brace 26, the sheaths 30, the worksurface supports 34 and the upper brace 44 are preferably made out of metal tubes with a rectangular cross-section, although other cross-sectional shapes are contemplated. The outer tubes 24 preferably have a U-shaped cross-section and an elongated U-shaped cover combining to give the outer tubes 24 a rectangular cross-section, although other cross-sectional shapes are contemplated.

Figure 10:
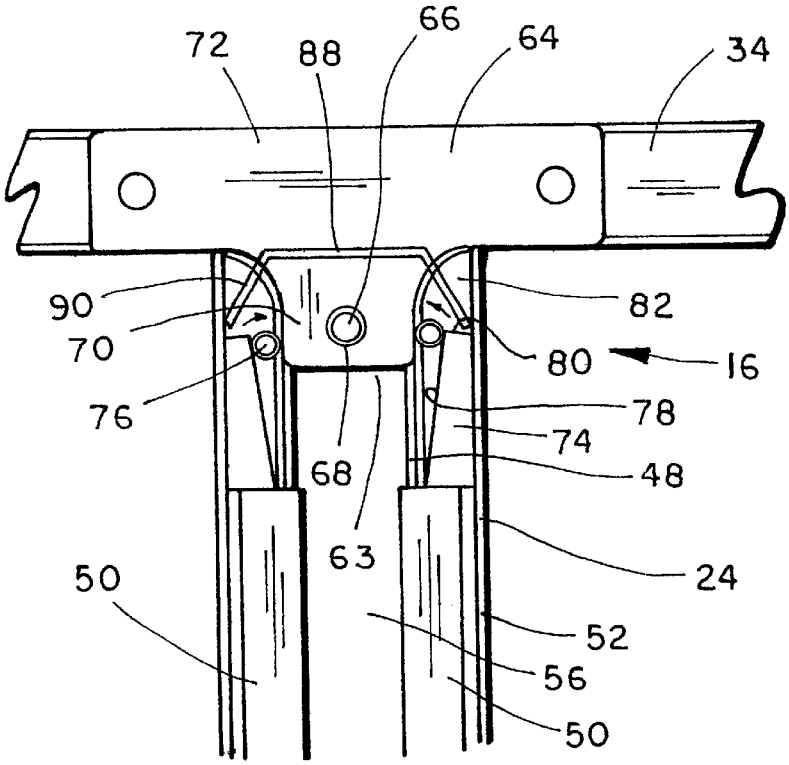
FIG. 10 is a side view of the top portion of the upright support of the present invention wherein a vertical reset is engaging a wedge pin and with the sheath and the side of the outer tube removed to reveal internal construction.
Figure 11:
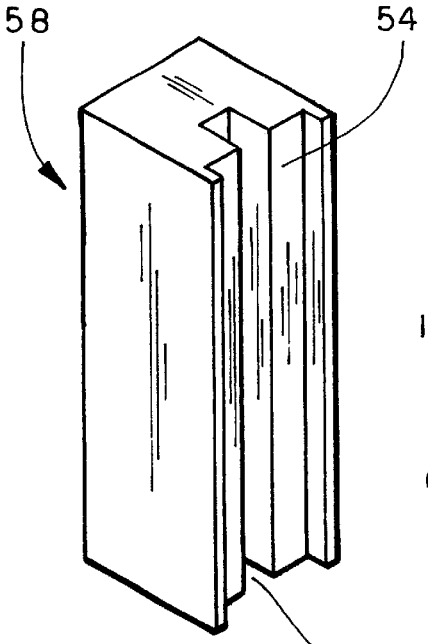
FIG. 11 is an isometric view of an inner tube guide of the present invention.

In the illustrated example, an inner tube 48 (FIGS. 5–10) telescopes with each of the outer tubes 24. The inner tubes 48 have substantially the same, although smaller, cross-sections and are substantially the same length as the outer tubes 24. The inner tubes 48 are held steady in the outer tube 48 with at least one inner tube guide 50. Preferably, two inner tube guides 50 are located opposite each other near a top end 52 of each of the outer tubes 24. The illustrated inner tube guides 50 (FIG. 11) are blocks with a vertical channel 54, which has a width slightly larger than the width of the inner tubes 48 in order to allow the inner tubes 48 to slide vertically within the outer tubes 24 with little lateral movement. It is contemplated that the inner tube guides 50 could have other shapes. For example, the inner tube guides 50 could be annular with a circular inside face slightly larger than the diameter of the inner tubes 48 if the inner tubes 48 were circular.

Within each of the inner tubes 48 is a dampener or free gas spring 56. The free gas spring 56 is connected at a first end 57 to a U-shaped connector 58. The U-shaped connector 58 has two apertures 60 in each opposite wall 62 for connecting to the first end 57 of the free gas spring 56. The U-shaped connector 58 is connected to the top surface 25 of the feet 20 within the inner tube 48 and the outer tube 26. The free gas spring 56 is connected at a second end 63 to the inner tube 48 and to two substantially planar T-shaped connectors 64. A pin 66 goes through a hole 68 in the bottom stem 70 of one of the two substantially planar T-shaped connectors 64, through a hole in a wall of the inner tube 48, through the second end 63 of the free gas spring 56, through another hole in an opposite wall of the inner tube 48 and though a hole 68 in the bottom stem 70 of another one of the two substantially planar T-shaped connectors 62. The tops 72 of the T-shaped connectors connect to the sides of the worksurface supports 34 thereby connecting the inner tubes 48 to the worksurface supports 34. Therefore, when the worksurface 14 is raised, the inner tubes 48 will raise. The free gas spring 56 is an air filled tube that allows the inner tubes 48 to lower smoothly and easily by counterbalancing the downward descent of the inner tubes 48 when the one-way locking apparatus 16 is disengaged. Therefore, the free gas spring 56 incorporates damping for a downward stroke to prevent a free-fall situation of the worksurface 14. The free gas spring 56 also counterbalances the weight of the inner tubes 48 and the worksurface against the pull of gravity, thereby allowing the inner tubes 48 to be adjusted upwardly with nearly a weightless feel.

Figure 12:
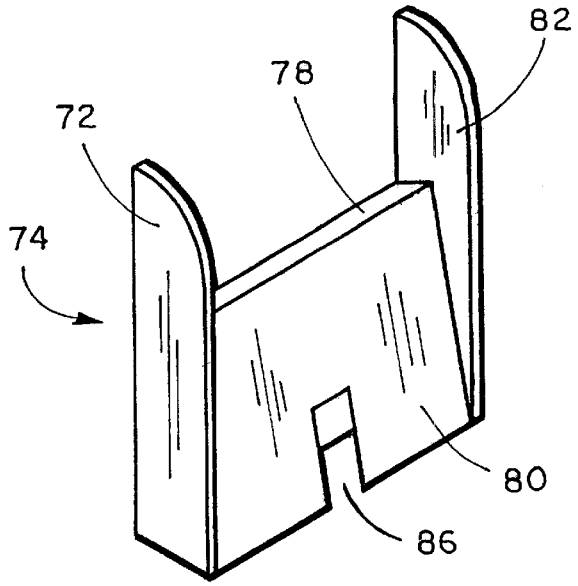
FIG. 12 is an isometric view of the wedge of the present invention.

In the illustrated example, the one-way locking apparatus 16 includes a wedge-engaging device 74, a wedge 76 and the inner tube 48. Each wedge-engaging device 74 sits atop one of the inner tube guides 50. The illustrated wedge-engaging device 74 (FIG. 12) has a ledge 78 and a frictional surface 80 between two wing shaped sides 82. The ledge 78 slopes upward at a small angle from the back of the wing shaped sides 82 near the outer tube 24 and near the top of the wing shaped sides 82 to about the center of the wing shaped sides 82. The frictional surface 78 slopes downward from the ledge 78 near the center of the wing shaped sides 82 to the bottom of the wing shaped sides 82 near the inner tubes 24. The frictional surface 78 therefore is adjacent the inner tube 48. The wedge 76 is wedged between the frictional surface 80 and the inner tube 48 to hold the inner tube 48, and therefore the upright support 12 is left in a vertically adjustable position. Preferably, the wedge 76 is a cylindrical roller. It is contemplated that wedge-engaging devices 74 and wedges 76 with different shapes can be employed. For example, if the inner tubes 48 and the outer tubes 24 are cylindrical, the wedges 76 can be spherical and the wedge-engaging devices 76 can be annular with the ledge 78 and the frictional surface 80 being conical.

Figure 6:
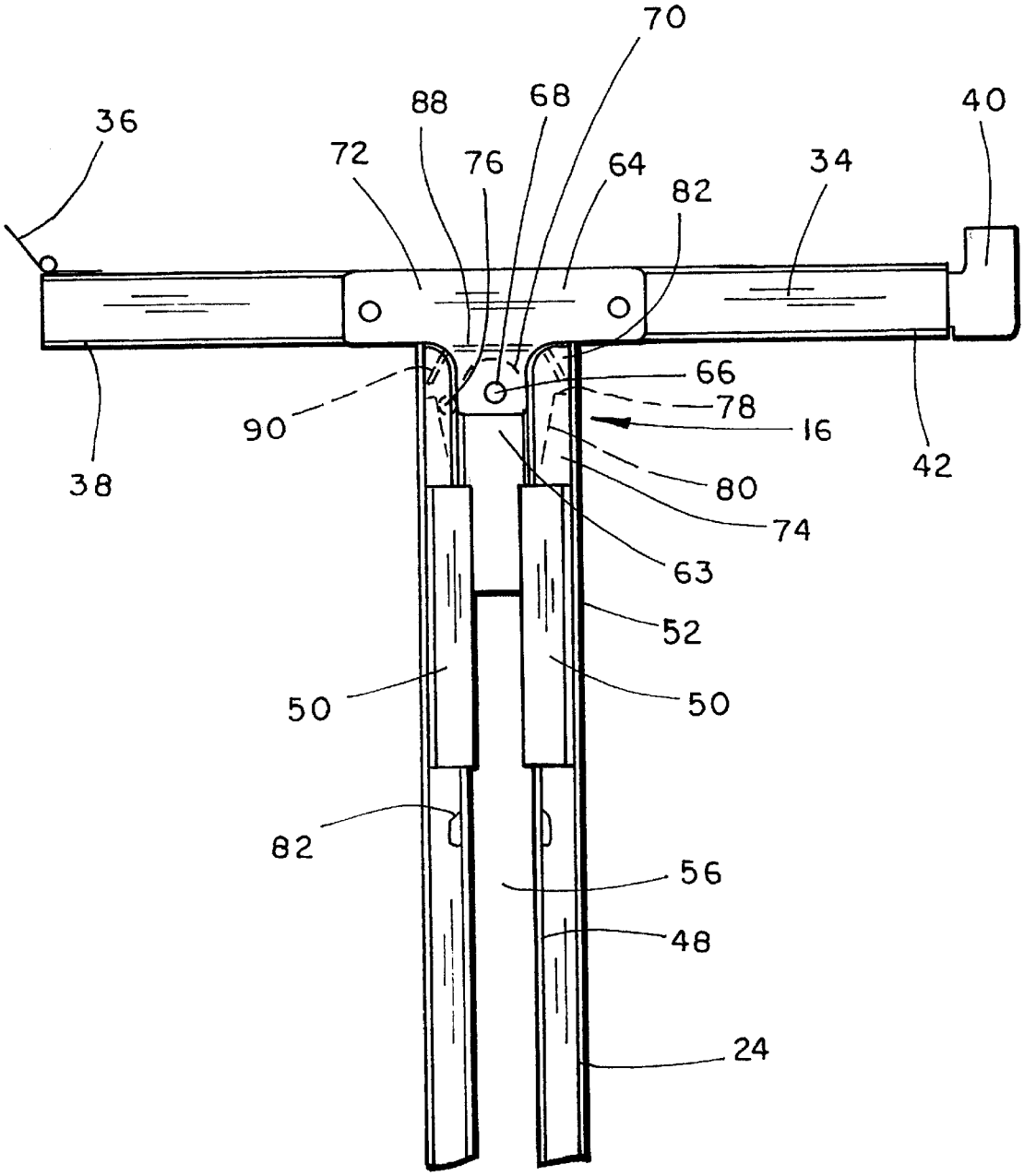
FIG. 6 is a side view of a top portion of the upright support with the sheath and the side of the outer tube removed to reveal the locking apparatus of the present invention.
Figure 7:
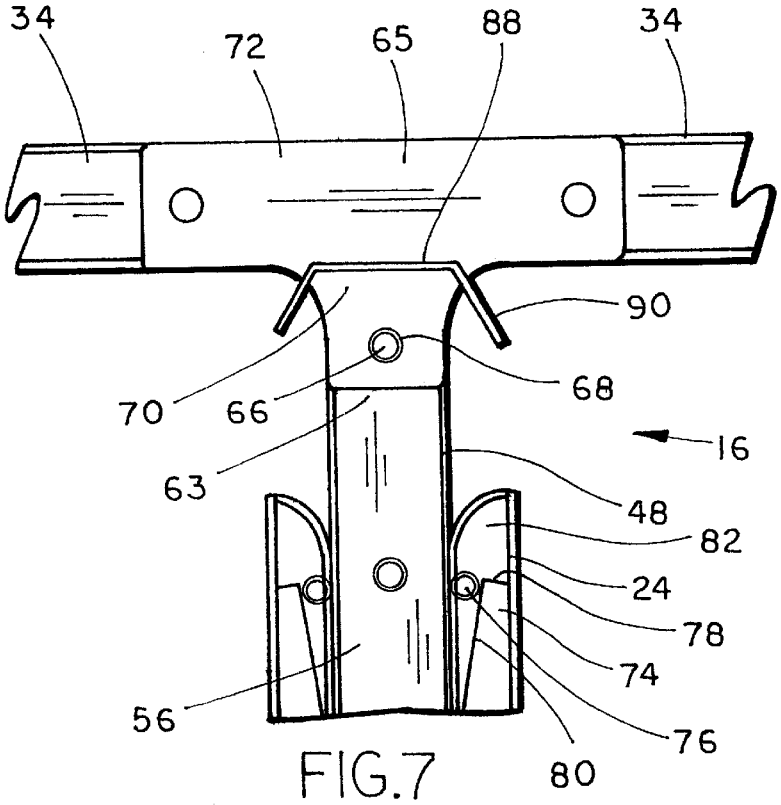
FIG. 7 is a side view of the top portion of the upright support with the worksurface in a vertically raised position and with the sheath and the side of the outer tube removed to reveal the locking apparatus of the present invention.

As seen in FIG. 6, the inner tubes 48, and therefore the upright support 12, start at a lowest vertical position. As the worksurface 14, worksurface supports 34, T-shaped connectors 62 and inner tubes 48 are raised from the lowest vertical position, as seen in FIG. 6, to a vertically adjusted position as seen in FIG. 7, the wedges 74 will freely roll and allow the inner tube 48 to raise. Once the worksurface 14 is released, the inner tubes 48 will lower until the wedges 76 once again wedge into a space between the frictional surface 80 and the inner tube 48. The inner tube 48 therefore will be able to stop at infinitely small increments. Furthermore, while the one-way locking apparatus 16 is engaged, the upright support 12 can only be upwardly vertically adjusted.

Figure 8:
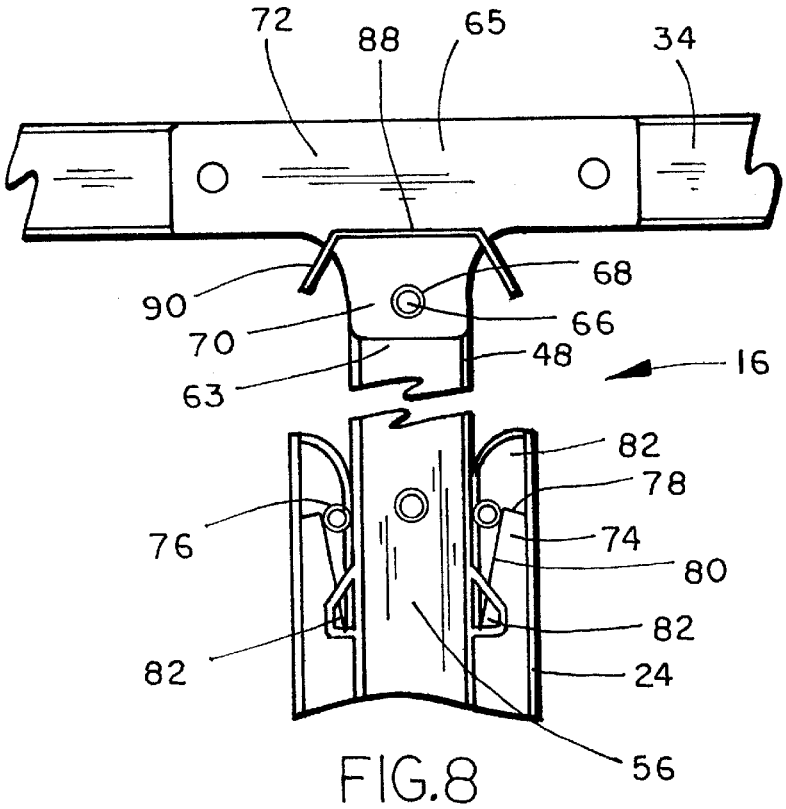
FIG. 8 is a side view of the top portion of the upright support of the present invention wherein fins are moving through a wedge and with the sheath and the side of the outer tube removed to reveal internal construction.
Figure 9:
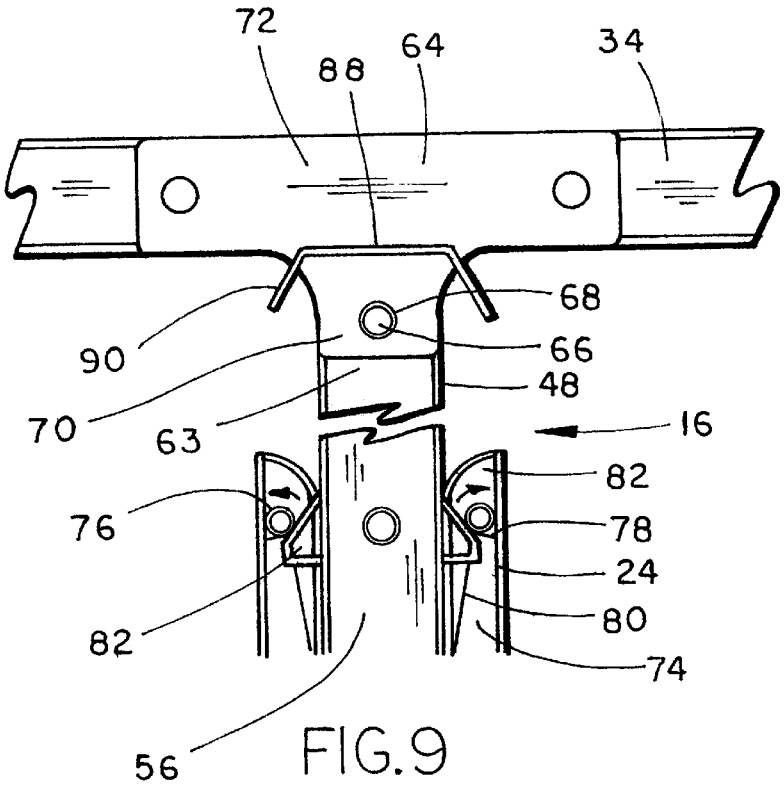
FIG. 9 is a side view of the top portion of the upright support of the present invention wherein fins are engaging a wedge pin and with the sheath and the side of the outer tube removed to reveal internal construction.

As seen in FIGS. 8 and 9, the one-way locking apparatus 16 disengages from the upright support 12 when the upright support 12 is fully extended and at least one fin 82 fixed on the inner tube 48 disengages the one-way locking apparatus 16. The number of fINs 82 preferably equal the number of wedges 76. In the illustrated example, the fins 82 are on outside opposite sides of each of the inner tubes 48 and are aligned with the inner tube guides 50 and the wedges 74. The fins 82 pass through grooves 84 in the center of each of the channels 54 in the inner tube guides 50 and through canals 86 in the center of each of the frictional surfaces 80 of the wedges 74. As a sloped top of the fins 82 come into contact with the wedge pins 76, the wedge pins 76 are raised over the ledge 78 and rest upon the ledge 78, thereby disengaging the one-way locking apparatus 16. Therefore, the inner tube 24 and the upright support 12 can freely be lowered.

As seen in FIG. 10, the one-way locking apparatus 16 reengages with the upright support 12 when the upright support 12 is lowered to the lowest vertical position. The one-way locking apparatus 16 is reengaged when a reset flange 88 on the top of the inner tube 24 knocks the wedge pin 76 off of the ledge 78 and back into the space between the frictional surface 80 and the inner tube 24, thereby reengaging the one-way locking apparatus 16. The reset flange 88 is a panel attached to the top of the inner tubes 24. The reset flange 88 has two side flaps 90 bent downward at an angle such that the side flaps 90 will push the wedge pins 76 between the frictional surface 80 and the inner tubes 24 when the inner tubes 24 are lowered to the lowest vertical position. It is contemplated that the reset flange 88 could be a downward depending conical skirt if inner tubes 48 and the outer tubes 24 are cylindrical. In the illustrated example, the sheaths 30 (FIGS. 1–4) cover the reset flange 88 and the bottom stem 70 of two opposite substantially planar T-shaped connectors 64 connected to one of the worksurface supports 34. Notably, it is contemplated that the one-way locking apparatus 16 and telescoping upright support 12 can be used in other furniture to provide a low-cost vertical height adjustment mechanism, such as on a chair or other furniture unit.

Figure 13:
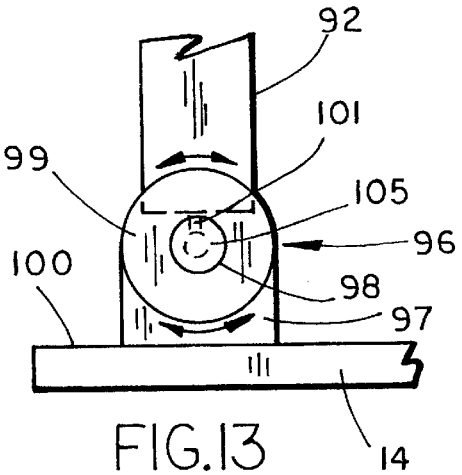
FIG. 13 is a side view of a locking gas spring and an upper pivot of an extendible locking device of the present invention.
Figure 14:
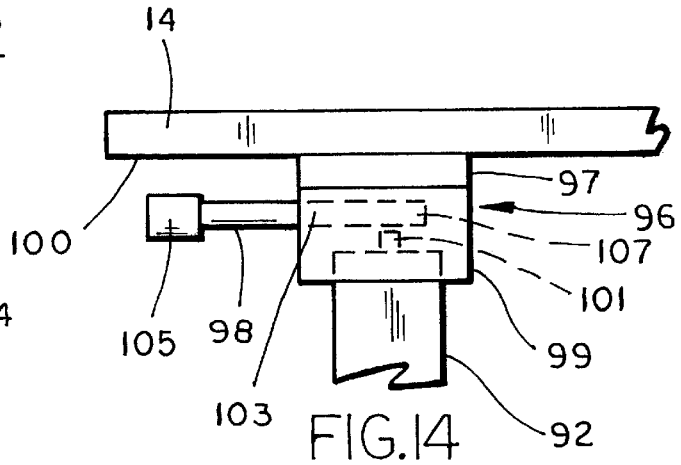
FIG. 14 is a front view of the locking gas spring and the upper pivot of an extendible locking device of the present invention.

As seen in FIGS. 1–4, the extendable locking device 18 has an extendable locking gas spring 92, a lower pivot 94, an upper pivot 96, and a release lever 98. The locking gas spring 92 is pivoted to the strap 32 by the lower pivot 94 and to the worksurface 14 by the upper pivot 96. The extendable locking device 18 is used to angularly adjust the worksurface 14 in an angularly adjustable position. As seen in FIGS. 13 and 14, the upper pivot 96 has a base 97 and an axle 99. The base 97 is fixed to a second surface 100 of the worksurface 14 and the axle 99 is connected to the base 97 opposite the second surface 100. The axle 99 is a wheel that rotates relative to the base 97 and the second surface 100. The axis of rotation of the axle 99 is substantially parallel to the upper brace 44. The locking gas spring 92 is fixed to the axle 99 and extends radially from the axle 99 away from the second surface 100. Likewise, the release lever 98 is fixed to the axle and extends axially from an end side wall of the axle 99. Therefore, the axle 99, the locking gas spring 92 and the release lever 98 rotate together relative to the base 97.

The extendible locking device 18 is used by pulling a handle 105 of the release lever 98 towards the second surface 100 of the worksurface 14. As the release lever 98 is pulled towards the second surface 100, the release lever 98 will pivot around a pin 103 in the end side wall of the axle 99. The pin 103 is located between the handle 105 and a distal end 107 of the release lever 98, thereby giving the release lever 98 an axis of rotation substantially parallel with the worksurface supports 34. When the release lever 98 is pulled, the distal end 107 of the release lever 98 pivots towards the locking gas spring 92 and presses a release valve 101 that extends linearly from an end of the locking gas spring 92. As the release valve 101 is depressed, the locking gas spring 92 can telescope to be smaller or longer in length. If the worksurface 14 is angularly adjusted from the horizontal position to the vertical position, the locking gas spring 92 will telescope to become longer. Likewise, if the worksurface 14 is angularly adjusted from the vertical position to the horizontal position, the locking gas spring 92 will telescope to become shorter. The locking gas spring 92 allows the worksurface 14 to be angularly adjusted to any angle between the horizontal position and the vertical position.

The illustrated worksurface 14 has an angularly adjusting handgrip 102 along a top edge of the worksurface 14 remote from the pivots 36 and two vertically adjusting handgrips 104 on opposite side edges of the worksurface 14. The angularly adjusting handgrip 102 is a crescent shaped divot approximately located in the center of the remote edge of the worksurface 14. The worksurface 14 is angularly adjusted by pulling the release lever 98 with a first hand, and pulling the worksurface 14 by the angularly adjusting handgrip 102 away from the worksurface supports 34 and towards the user with a second hand. Likewise, the two vertically adjusting handgrips 104 are crescent shaped divots approximately located near the hinges 36. Alternatively, it is contemplated that the vertically adjusting handgrips 104 could be D-shaped holes within the worksurface 14 adjacent the hinges 36. The worksurface 14 is vertically adjusted by lifting the worksurface 14 at the two vertically adjusting handgrips 104. Therefore, the worksurface 14 can be angularly and vertically adjusted by using the adjusting handgrip 102 and the two vertically adjusting handgrips 104 until a desired vertical and angular position of the worksurface 14 is reached.

Figure 15:
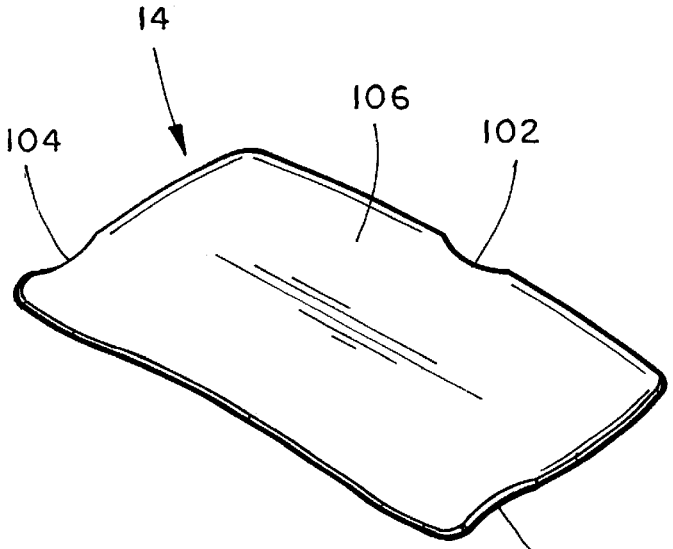
FIG. 15 is a perspective view worksurface of the present invention.

The illustrated worksurface 14 includes a base of a clear rigid sheet with a first surface 106 and the second surface 100. Preferably, the base is made of glass or other transparent sheet. Most preferably, the base is made of an acrylic plastic sheet, which is sold under the trade name PLEXIGLAS by Rohm and Haas Company. Preferably, the base is 0.5" or more thick. The worksurface 14 is preferably made by first applying a medium gloss coating to the second surface 100. A medium gloss is 40–90% on the 60° gloss meter. Preferably, the coating on the second surface 100 is a coating with an acrylic base resin or a urethane acrylate. Most preferably, the coating to the second surface 100 is a polysiloxane coating with an approximate gloss level of 50. An adhesive coating is then applied to the first surface 106. The adhesive is preferably a pressure sensitive coating. Covering the adhesive coating is a polyester film. It is contemplated that the polyester film could be PBT, which is sold under the trade name VALOX FR1 101 by General Electric. Finally, a low gloss coating is applied on the film. A low gloss is under 40% on the 60° gloss meter. Preferably, the low gloss coating is an acrylic coating or a polysiloxane coating 0.5–1 mils thick with an approximate gloss level of 20–30. In an alternative embodiment, the medium gloss coating is not applied to the second surface 100. During manufacturing of the worksurface, the polyester film usually has a pressure sensitive adhesive on one side of the film and a release sheet protecting and covering the pressure sensitive adhesive. The low gloss coating is preferably laminated onto the polyester film and the release sheet is removed. As seen in FIG. 15, a coated film 108 comprising the polyester film and the laminated low gloss coating is preferably applied by simultaneously feeding the polyester film with the low gloss coating and the clear rigid sheet through nip rollers 110 that press the film onto the clear rigid sheet. The medium coating is preferably coated to the second surface 100 of the clear rigid sheet before the clear rigid sheet is ran through the rollers. The film, which overhangs the clear rigid sheet after being rolled, is then trimmed with a knife or router.

The worksurface 14 is a translucent panel within the first surface 106 and the second surface 100. The first surface 106 is textured so that it can be used both as a projection screen and as a marker board. The coating on the film 108 on the worksurface 14 provides the texture and a low roughness to the first surface 106 that allows a user to use a dry erase marker on the first surface 106. The coated film 108 on the first surface 106 also provides a white color that will reflect a first projected image to be viewed on the projection screen when an image is projected towards the first surface 106. Furthermore, the film supplies enough roughness to the first surface 106 to provide a clear first projected image, but with a low glare from the first surface 106. The worksurface 12 will also transmit the first projected image through the worksurface 14 to be viewed from the second surface 100 on the projection screen. The worksurface 14 can therefore be used as a front viewing projection screen and a back viewing projection screen. Moreover, since the worksurface 12 is vertically adjustable, the projection screen easily adjusts to the appropriate height of the image coming from the projector. Likewise, the coating on the second surface 100 provides a texture and a low roughness to the second surface 100 that allows a user to use a dry erase marker on the second surface 100. In an alternative embodiment, the second surface 100 does not have a coating and a dry erase marker and can not be used effectively on the second surface 100. When the first surface 106 and the second surface 100 are coated, they become textured so that they do not have any sharp edges or depressions that would provide an area where erasable material could not be erased. Furthermore, the film on the first surface 106 and the coating on the second surface 100 provide protection for the base sheet. Therefore, the worksurface 14 has the first surface 106 that can be used as a front projection screen, a rear projection screen and a first erasable marker board, and has the second surface 100 that can be used as a second erasable marker board.

In the forgoing description, it will be readily appreciated by those skilled in the art that modifications may be made to the invention without departing from the concepts disclosed herein. For example, the upright support 12 could be comprised of only one leg having only one outer tube 24, one sheath 30, one inner tube 48, one one-way locking apparatus 16, and one of every element associated with vertically adjusting the worksurface 14. With only one leg, the foot 20 of the upright support 12 would be have to be modified in order to enable the portable table 10 to firmly stand upright. Furthermore, the worksurface supports 34 would have to be modified in order to attach to the upright support 12. Such modifications are to be considered as included in the following claims, unless these claims by their language expressly state otherwise.

We claim:

1. A portable table comprising:

a vertically adjustable upright support;

a worksurface connected to the upright support; and a one-way locking apparatus engagable with the upright support for locking the upright support in a vertically adjustable position;

wherein while the one-way locking apparatus is engaged, the upright support is only upwardly vertically adjustable;

wherein the one-way locking apparatus disengages from the upright support when the upright support is fully extended and reengages with the upright support when the upright support is lowered to a lowest vertical position;

wherein the one-way locking apparatus comprises an inner tube within the upright support, a wedge-engaging device adjacent the inner tube, and a wedge located between the inner tube and the wedge-engaging device frictionally holding the inner tube and the upright support in the vertically adjustable position;

wherein the wedge includes a cylindrical roller; and wherein a fin fixed on the inner tube disengages the one-way locking apparatus when the upright support is fully extended.

2. The portable table as set forth in claim 1, wherein:

the wedge-engaging device includes a ledge; and the fin disengages the one-way locking apparatus by raising the cylindrical roller onto the ledge of the wedge-engaging device.

3. The portable table as set forth in claim 2, wherein:

a reset flange on the top of the inner tube reengages the one-way locking apparatus when the upright support is lowered to the lowest vertical position.

4. The portable table as set forth in claim 3, wherein:

the wedge-engaging device further includes a frictional surface; and the reset flange reengages the one-way locking apparatus by knocking the cylindrical roller from the ledge on the wedge-engaging device into a space between the inner tube and the frictional surface on the wedge-engaging device.

5. The portable table as set forth in claim 4, wherein:

the upright support includes floor-engaging castors for easily moving the table.

6. The portable table as set forth in claim 1, wherein:

the worksurface is pivotally connected to the upright support; and an extendable locking device is pivotally connected to the upright support and to the worksurface for locking the worksurface in an angularly adjustable position.

7. The portable table as set forth in claim 6, wherein:

the extendable locking device comprises a locking gas spring connected to the upright support and the worksurface;

wherein the locking gas spring has a release handle that allows the locking gas spring to adjust an angle of the worksurface.

8. The portable table as set forth in claim 7, wherein:

the locking gas spring has a release valve; and the release handle depresses the release valve on the locking gas spring thereby allowing the locking gas spring to adjust the angle of the worksurface.

9. The portable table as set forth in claim 6, wherein:

hinges pivotally connect the worksurface to the upright support.

10. The portable table as set forth in claim 1, wherein:

the worksurface comprises a translucent panel with a first surface and a second surface opposite to the first surface.

11. A portable table comprising:

a vertically adjustable upright support;

a worksurface connected to the upright support; and a one-way locking apparatus engagable with the upright support for locking the upright support in a vertically adjustable position;

wherein while the one-way locking apparatus is engaged, the upright support is only upwardly vertically adjustable;

wherein the one-way locking apparatus disengages from the upright support when the upright support is fully extended and reengages with the upright support when the upright support is lowered to a lowest vertical position;

the worksurface comprises a translucent panel with a first surface and a second surface opposite to the first surface; and wherein the first surface has a surface finish configured to be used as a projection screen and a first erasable marker board, the first surface is configured to reflect a first projected image to be viewed on the projection screen, the worksurface is configured to transmit the first projected image through the worksurface to be viewed from the second surface on the projection screen, and the worksurface is movable between a horizontal position for doing paperwork and a vertical position for acting as a double-sided projection screen, whereby the worksurface can be used for many tasks by people on either side or on both side of the worksurface.

12. The portable table as set forth in claim 11, wherein:

the one-way locking apparatus comprises:

an inner tube within the upright support;

a wedge-engaging device adjacent the inner tube; and a wedge located between the inner tube and the wedge-engaging device frictionally holding the inner tube and the upright support in the vertically adjustable position.

13. The portable table as set forth in claim 12, wherein:

the wedge includes a cylindrical roller.

14. The portable table as set forth in claim 11, wherein:

the second surface has a surface configured to be used as a second erasable marker board.

15. A portable table comprising:

a vertically adjustable upright support;

a worksurface connected to the upright support; and a one-way locking apparatus engagable with the upright support for locking the upright support in a vertically adjustable position;

wherein while the one-way locking apparatus is engaged, the upright support is only upwardly vertically adjustable;

wherein the one-way locking apparatus disengages from the upright support when the upright support is fully extended and reengages with the upright support when the upright support is lowered to a lowest vertical position;

wherein the worksurface comprises a rigid transparent sheet with a first surface and a second surface, a medium coating applied to the second surface, a translucent film applied on the first surface, and a low gloss coating applied on the translucent film.

16. The portable table as set forth in claim 15, including at least one gas spring operably connected to the upright support for counterbalancing a weight of the worksurface during vertical height adjustment of the worksurface.

17. A portable table comprising:

a vertically adjustable upright support;

a translucent planar member pivotally connected to the vertically adjustable upright support; and an extendable locking device pivotally connected to the upright support and to the translucent planar member for locking the translucent planar member in an angularly adjustable position;

the extendable locking device comprising a locking gas spring connected to the upright support and the translucent planar member;

wherein the locking gas spring has a release handle that allows the locking gas spring to adjust the angle of the translucent planar member;

the locking gas spring having a release valve;

wherein the release handle depresses the release valve on the locking gas spring thereby allowing the locking gas spring to adjust the angle of the translucent planar member; and the translucent planar member comprises a rigid transparent sheet with a first surface and a second surface, a medium gloss coating applied to the second surface, a translucent film applied on the first surface and a low gloss coating applied on the translucent film.

18. The portable table as set forth in claim 17, wherein:

hinges pivotally connect the worksurface to the upright support.

19. A worksurface comprising:

a translucent panel with a first surface and a second surface opposite to the first surface the first surface having a surface finish configured to be used both as a projection screen and as a first erasable marker board;

wherein the first surface is configured to reflect a first projected image to be viewed on the projection screen;

wherein the translucent panel is configured to transmit the first projected image through the worksurface to be viewed from the second surface on the projection screen; and whereby the translucent panel can be used for many tasks by people on either side or on both sides of the translucent panel;

a vertically adjustable upright support, with the translucent panel connected to the upright support; and a one-way locking apparatus engagable with the upright support for locking the upright support in a vertically adjustable position;

wherein while the one-way locking apparatus is engaged, the upright support are only upwardly vertically adjustable; and wherein the one-way locking apparatus disengages from the upright support when the upright support is fully extended and reengages with the upright support when the upright support is lowered to a lowest vertical position.

20. The worksurface as set forth in claim 19, wherein:

the one-way locking apparatus comprises:

an inner tube within the upright support;

a wedge-engaging device adjacent the inner tube; and a wedge located between the inner tube and the wedge-engaging device frictionally holding the inner tube and the upright support in the vertically adjustable position.

21. A worksurface comprising:

a translucent panel with a first surface and a second surface opposite to the first surface;

the first surface having a surface finish configured to be used both as a projection screen and as a first erasable marker board;

wherein the first surface is configured to reflect a first projected image to be viewed on the projection screen;

wherein the translucent panel is configured to transmit the first projected image through the worksurface to be viewed from the second surface on the projection screen; and whereby the translucent panel can be used for many tasks by people on either side or on both sides of the translucent panel;

a vertically adjustable upright support, with the translucent panel pivotally connected to the vertically adjustable upright support; and an extendable locking device pivotally connected to the upright support and to the translucent panel for locking the translucent panel in an angularly adjustable position.

22. The worksurface as set forth in claim 21, wherein:

the extendable locking device comprises a locking gas spring connected to the upright support and the translucent panel; and wherein the locking gas spring has a release handle that allows the locking gas spring to adjust the angle of the translucent panel.

23. The worksurface as set forth in claim 22, wherein:

the locking gas spring has a release valve; and the release handle depresses the release valve on the locking gas spring thereby allowing the locking gas spring to adjust the angle of the translucent panel.

24. The worksurface as set forth in claim 21, wherein:

hinges pivotally connect the translucent panel to the upright support.

25. A method of using a worksurface comprising:

providing a translucent panel with a first surface and a second surface opposite to the first surface;

configuring the first surface to have a surface finish to be used both as a projection screen and as a first erasable marker board;

configuring the first surface to reflect a first projected image to be viewed on the projection screen;

configuring the panel to transmit the first projected image through the panel to be viewed from the second surface on the projection screen; and moving the panel between a horizontal position for doing paperwork and a vertical position for acting as a double-sided projection screen.

26. The method of using a worksurface as set forth in claim 25, further including:

providing the second surface with a surface finish configured to be used a second erasable marker board.

27. The method of using a worksurface as set forth in claim 25, further including:

providing an upright support;

connecting the panel to the upright support; and providing the upright support with floor-engaging castors for easily moving the upright support.

28. The method of using a worksurface as set forth in claim 25, further including:

providing an upright support;

connecting the panel to the upright support;

pivotally connecting the panel to the upright support; and pivotally connecting an extendable locking device to the upright support and to the worksurface for locking the worksurface in an angularly adjustable position.

29. The method of using a worksurface as set forth in claim 25, wherein:

the panel includes a rigid transparent sheet with the first surface and the second surface;

the surface finish includes a translucent film and a low gloss coating;

further including the steps of applying a medium coating to the second surface, applying the translucent film on the first surface and applying the low gloss coating on the translucent film.

30. The method of using a worksurface as set forth in claim 25, further including:

providing a vertically adjustable upright support; and connecting the panel to the upright support.

31. The method of using a worksurface as set forth in claim 25, further including:

providing an upright support;

connecting the panel to the upright support; and engaging a one-way locking apparatus with the upright support for locking the upright support in a vertically adjustable position, the upright support being only upwardly vertically adjustable while the one-way locking apparatus is engaged, but the one-way locking apparatus being configured to disengage from the upright support when the upright support is fully extended and being configured to reengage with the upright support when the upright support is lowered to a lowest vertical position.

* * * * *

UNITED STATES PATENT AND TRADEMARK OFFICE

CERTIFICATE OF CORRECTION

PATENT NO. : 6,354,227 B1
DATED : March 12, 2002
INVENTOR(S) : Thomas G. Feldpausch et al.

It is certified that error appears in the above-identified patent and that said Letters Patent is hereby corrected as shown below:

Title page,
Item [75], Inventors, "Mitchell Niewiadowski" should be -- Mitchell Niewiadomski --.

Column 2,
Line 43, before "side" insert -- a --.

Column 3,
Line 35, "including" should be -- includes --.
Line 47, after "connected" insert -- to --.

Column 5,
Line 48, "fINs" should be -- fins --.

Column 7,
Line 49, "is ran" should be -- is run --.

Column 8,
Line 29, before "have" delete "be".

Column 10,
Line 5, "side" (second occurrence) should be -- sides --.

Column 12,
Line 35, after "used" insert -- as --.

Signed and Sealed this

Twenty-sixth Day of November, 2002

*Attest:*

*Attesting Officer*

JAMES E. ROGAN
*Director of the United States Patent and Trademark Office*